2-2-59 40 157 EX

2/26/85 XP 4,501,681

United States Patent [19]

Groult et al.

[11] Patent Number: 4,501,681

[45] Date of Patent: Feb. 26, 1985

[54] DETERGENT DISH-WASHING COMPOSITION

[75] Inventors: Alain Groult, Annemasse, France; Jean Samec, Geneva, Switzerland

[73] Assignee: Colgate-Palmolive Company, New York, N.Y.

[21] Appl. No.: 451,527

[22] Filed: Dec. 20, 1982

[30] Foreign Application Priority Data

Dec. 23, 1981 [CH] Switzerland ..... 8234/81

[51] Int. Cl.[3] ..... C11D 3/386; C11D 3/39

[52] U.S. Cl. ..... 252/174.12; 252/95; 252/99; 252/DIG. 12; 252/DIG. 14

[58] Field of Search ..... 252/99, 174.12, DIG. 12, 252/95, DIG. 14

[56] References Cited

U.S. PATENT DOCUMENTS 3,789,001 1/1974 Painelli ..... 252/DIG. 12 X 4,162,987 7/1979 Maguire, Jr. et al. ..... 252/174.16 X

FOREIGN PATENT DOCUMENTS 1275301 5/1972 United Kingdom .

*Primary Examiner*—John E. Kittle

*Assistant Examiner*—Mukund J. Shah

*Attorney, Agent, or Firm*—Herbert S. Sylvester; Murray M. Grill; Norman Blumenkopf

[57] ABSTRACT

Dish-washing composition containing alkali polyphosphates and silicates, surfactants, peroxized oxygerating agents, enzymes and sufficient alkali for providing a washing bath of pH 11.5.

4 Claims, 1 Drawing Figure

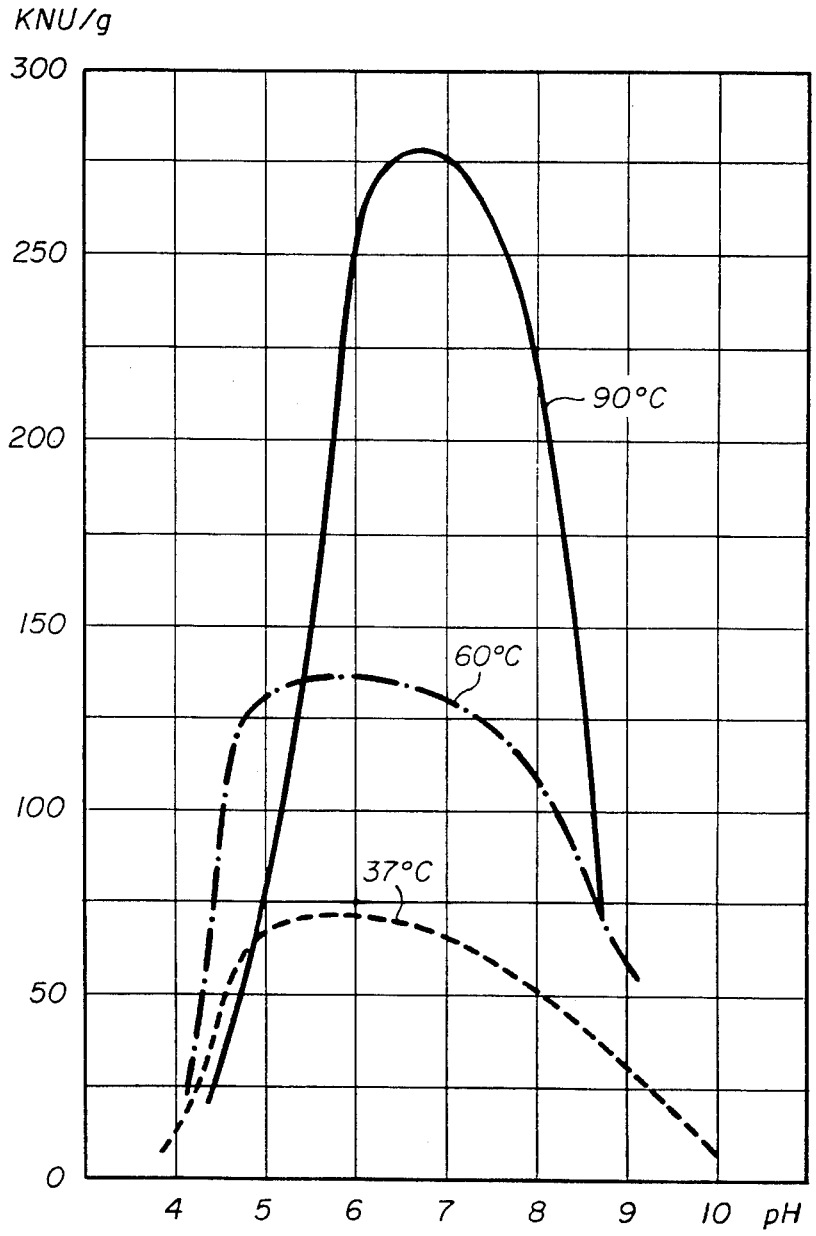
KNU/g
300
250
200
150
100
50
0
4
5
6
7
8
9
10
pH
90°C
60°C
37°C

DETERGENT DISH-WASHING COMPOSITION

BACKGROUND OF THE INVENTION

The present invention concerns a detergent dish-washing composition. This composition can be used in solid granulated or powder form but this condition is in no way necessary and the composition can also be used in any other convenient usual form, including the liquid form in special cases.

Detergent products for dish-washing are generally formulated so as to provide, after dissolution into water, a cleaning bath for removing soils of many different kinds such as vegetable fibers, protein soils, amylaceous products, dyes, tannins, burnt residues and the like; however, cleaning solutions should not simultaneously attack and corrode kitchen and dinner-ware made of glass, ceramic, china and metal. Further, cleaning solutions should be able to prevent a redeposition of mineral contaminants on the cleaned articles, such contaminants forming unpleasant films or spots on the washed surfaces.

In order to reconcile together the aforementioned requirements, the known dish-washing compositions generally contain inert or near to inert mineral salt builders whose purpose is to provide a degree of ionic strengh to the bath and to act as buffering agents. As such fillers, one can mention alkali metal sulfates, phosphates, polyphosphates, carbonates, silicates and chlorides; and other alkali salts, alkali metal salts of organic acids and neutral compounds such as urea. By virtue of their surfactive properties, polyphosphates enable the removal of certain kinds of soils, namely fatty deposits by emulsification. They also act as antiredeposition agents because of their dispersive properties and they promote the dissolving of casein with formation of sodium caseinate. The added silicates are effective for controlling the alkaline pH of the bath as a function of the concentration and of the alkali metal content thereof; they also act as corrosion inhibitors. Dish-washing compositions further contain sud-repressing surfactants and other additives such as soil-suspending ingredients, drainage promoting ingredients, perfumes, softeners and the like. A fully detailed description of the general features relative to dish-washing compositions can be found in U.S. Pat. No. 4,162,987 (MAGUIRE et al).

In addition to the above-mentioned ingredients, dish-washing composition may also comprise "chlorine donor" bleaches, i.e. products which provide active chloride after hydrolysis in the bath, said chlorine being active for oxidative and disinfection purposes. The dish-washing products may also include enzymes for catalytically hydrolyzing food residues. The most important enzymes are the proteolytic and amylolytic enzymes.

Enzymes impart a significant cleaning power to the dish-washing compositions but they are unstable in the presence of chlorine bleaches and, particularly in the case of amylolytic enzymes, they normally lose their activity in the bath at the high pH values which are normally necessary for efficient dish-washing activity.

Hence, the dish-washing detergent taught in the aforementioned U.S. Pat. No. 4,162,987 comprises enzymes but no chlorine bleach and the pH of the solution never exceeds 11.5, so as to prevent deactivation of the amylolytic enzymes ($\alpha$-amylases). Such pH value is, however, only a lower limit regarding washing efficiency in dish-washers. Further, in the absence of oxidants such as the common chlorine bleaches, certain food residues, e.g. tea residues, are not sufficiently eliminated which is a major drawback.

Other prior art of some relevance includes French Pat. Nos. 1561078 & 2035547 and German DOS No. 2109389. French No. 1561078 describes laundry washing agents containing enzymes, which are stated to be active in the pH range of approximately 4 to 12. There is no clear showing of whether the pH of the washing solutions shown is in fact below 11.5. The enzymes are attached to a hydratable salt to protect the enzyme. As the patent makes manifestly clear the carbohydrases (e.g. amylase) function primarily in acid to neutral systems.

French Pat. No. 2035547 also relates to clothes laundering detergent compositions. In this patent the life of amylase enzyme is prolonged by intimate contact with starch. The detergent composition are those which in aqueous solution (0.12%) have a pH of from about 8.5 to about 11.

German (DOS) No. 2109389 also relates to protecting enzymes (during storage) utilizing certain glucose polymers in admixture with derivatives of mono-saccharides. The only mention of the pH of a laundry solution is one with a pH of 9.

SUMMARY OF THE INVENTION

It has now been surprisingly noticed, and this finding constitutes one of the fundamentals of the present invention, that, although the activity of the amylolytic enzymes is indeed practically naught at pH values above 11.5, the presence of these enzymes in the detergent composition imparts to the resulting washing bath a remarkable and surprising washing ability toward amylaceous residues at pH values exceeding 11.5. In addition, it has also been noticed that it is possible to incorporate, as replacement for the chlorine bleaches in such a composition, mineral or organic peroxides without significantly impairing the cleaning efficiency of the enzymes.

Briefly summarized, the detergent dish-washing composition according to the invention which includes alkali metals polyphosphates and silicates, at least one non-ionic surfactant and an oxidizing agent, enzymes and further conventional detergency and other additives, is characterized in that the enzymes comprise at least one amylolytic enzyme whose activity is considered negligible at a pH above 11.5, at least one mineral or organic peroxide as the oxidant, and in that the pH of the bath obtained therefrom for use in a dish-washing machine is not below 11.5.

DETAILED DESCRIPTION OF THE INVENTION

Practically, this pH can be chosen between 11.5 and 12.5, although higher pH values are also possible if desired. The exact value of the pH within the above mentioned limits can be adjusted by means of the amount of alkali in the composition. This alkali can be represented by suitable amounts of alkali metal hydroxides and/or of alkali metal silicates. The alkali metal silicates can be potassium, lithium or sodium silicate with a $Na_2O/SiO_2$ mole-ratio of, for instance, 0.3 to 4.0, and its amount by weight in the composition for providing the desired pH will depend on the particular selected value of said mole ratio.

More specifically, the quantities by weight of the key ingredients in the present dish-washing composition are as follows:

| | |
|---|---|
| Alkali metals (Na, K or Li) polyphosphates | 10–70% |
| Alkali metals (Na, K or Li) silicates | 25–70% |
| Non-ionic surfactants | 0.2–5% |
| Amylolytic enzymes (specific activity 60 kNU/g) | 0.1–5% |
| Peroxide compounds | 1–20% |

The remainder to make 100% by weight is constituted by the other detergency additives mentioned above. As such additives, the following ones can be mentioned: alkaline materials, chelatants and sequestrants, anti-redeposition agents, corrosion inhibitors such as some complex aluminates, zincates or phosphates (see also U.S. Pat. No. 3,410,804), anti-tarnishing agents, bactericides, anti-foam agents, polyelectrolytes, oligo- and polysaccharides, mineral softeners, urea and the like. All these agents are known from those skilled in the art and disclosed in many publication (see for instance: DETERGENCY by W. G. CUTLER and R. C. DAVIS, Mr. DEKKER Inc., New York and Basel 1981)). As peroxide compounds, one can mention for instance alkali metals perborates, persulfates, percarbonates, peracetates and perbenzoates but these examples are not limitative, other peroxides known in this field being also possible. For embodying the invention, one prefers using alkali metal perborates, preferably sodium perborate, because of easy availability and stability and because they have anti-tarnish properties (see U.S. Pat. No. 3,549,539).

As amylolytic enzymes, one can use most enzymes of this category unless they are destroyed during storage by the effect of the other ingredients of the composition or, when in solution, by the effect of the same ingredients dissolved in the washing bath. However, as heretofore mentioned, it is immaterial that the activity of the amylases used in the composition becomes zero or at the least non-measurable according to usual means under the operating conditions of the present composition, the washing power contribution of said amylases being considerable despite the already cited inhibitory effect of high pH solutions. Such amylolytic enzymes effective according to the present invention are described in detail in British Pat. No. 1,296,839 and in aforementioned U.S. Pat. No. 4,162,987. One prefers to use the amylolytic enzymes commercially available under the name of "TERMAMYL" (NOVO INDUSTRI A/S, Bagsvaerd, Denmark).

The present composition can also comprise 0.1 to 5% by weight of proteolytic enzymes (specific activity 4 units KNP/g). Such enzymes are described in detail in British Pat. No. 1,361,386. One prefers using, as proteolytic enzymes, the substances available under the name of "ESPERASE" (NOVO INDUSTRI A/S, Bagsvaerd, Denmark).

It should be remarked that the effect of the proteolytic enzymes is somewhat decreased by the presence of peroxides; however, this inhibitory effect is of little significance as it occurs only at a later stage of the washing operation since peroxides, and more particularly perborates, dissolve only slowly in the scouring bath and only provide their full oxidative potency at the end of the washing cycle.

The nature of the surfactants usable within the scope of the present invention is not critical and most commercial non-ionic surfactants normally used in dish-washing compositions are suitable. A listing of such surfactants is found in U.S. Pat. No. 3,666,961 and 4,162,987.

Preferably, the used surfactants are polyoxyalkylated fatty esters derived from polyoxyalkylated fatty acids or alcohols in which the term "polyoxyalkyl" preferably designates the polyoxyethylene and polyoxypropylene chain segments. The fatty acids can be, for instance, oleic acid, palmitic acid, myristic acid, stearic acid and the like. The fatty alcohols can be, for instance, lauryl alcohol, oleyl alcohol, tallow alcohols and the like. Preferably, the surfactants used in the present composition have antifoam or sud-repressing properties.

As alkali metal silicates, one can use most of the usual water soluble alkali metal silicates (metasilicates, orthosilicates), the mole-ratio $SiO_2/ME_2O$ of which (ME being Na or K) is comprised between 0.30 and 4.0. This ratio value is however not essential because in case there is a lack of alkali metal in the silicate, this deficiency can be corrected by adding a corresponding compensating quantity of alkali metal hydroxide to the present composition. In any event, the quantity of alkali metal compound of the composition should be such as to provide, after dissolution of the composition in water (at the concentration of generally 2–10 g of solids per liter), a pH comprised between 11.5 and 12.5 and preferably of 12.2 to 12.4.

The polyphosphates to be used in the present composition are the commercially available alkali metal polyphosphates normally used in compositions for household applications (cloth and fabric washing compositions). These polyphosphates essentially comprise tripolyphosphate together with pyrophosphates and monophosphates; occasionally they may contain polyphosphates with more than three orthophosphate units in the chain. The nature of these polyphosphates is not critical in the present composition but at least some polyphosphates should be present to ensure an effective washing of the dishes and a sequestering effect of the hard earth-alkali metal ions in the washing waters.

Thus, in short, the composition according to the invention offers the following advantageous properties as compared to the corresponding products known from the art:

(a) The washing efficiency with regard to common dish soils exceeds or at least equals that of the known products.

(b) The composition is economical because it particularly suits the so called "mild" or "soft" washing cycles which require less water, less time and a temperature (40°–50° C.) lower than with a "regular" washing cycle (55°–65° C.).

(c) The washing solution is less corrosive toward the glass and metals of table wares and it will spare the dainty dishes since the water pressure associated with the short cycles is lower than the pressure used in a normal cycle.

(d) The washing efficiency is markedly better toward some of the soils, namely amylaceous soils.

(e) Prewashing steps can be deleted which saves a lot of time because the used dishes of several successive meals can be stored in the dish-washer without prewashing until it is full, drying of the food residues before eventual washing being of no importance.

(f) Terminal rinsing is improved particularly in regard to glasses, which enables to use less rinsing product as compared with conventional rinsing.

(g) Since the composition comprises no chlorine bleach, various sensitive ingredients can be added thereto for improving the washing conditions, namely fragrant compounds, (it is normally not possible to add perfumes to chlorine containing detergents as they would be distroyed completely by said chlorine).

(h) Due to the aforementioned improvements, the composition of the invention enables one to save time and energy and by reason of its increased power, it can be used at lower effective concentration as compared with conventional dish-washing detergents, which condition contributes to decrease pollution by the phosphates.

The following Examples illustrate the invention on a practical stand point.

BRIEF DESCRIPTION OF THE DRAWING

The annexed drawing, whose information is used as a reference only, represent graphically the variation of activity of a typical α-amylase at different temperatures and pH values. This information is reproduced from a data sheet by NOVO INDUSTRI, Bagsvard, Denmark (sheet B204 c-GB-1500, July 1980) concerning amylolytic enzymes sold under the trade mane of TERMAMYL.

EXAMPLE 1

A basic mixture (C) for a dish-washing composition was prepared with the following ingredients (parts by weight)

| | | |
|---|---|---|
| Sodium tripolyphosphate | 11.8 | |
| Sodium metasilicate ($5H_2O$) | 18.7 | (or 10.8 if anhydrous) |
| Sodium perborate | 1.5 | |
| Urea | 4.5 | |
| Non ionic surfactant (PLURIOL PE-6100) | 0.45 | |
| Proteolytic enzyme (ESPERASE) | 0.6 | |
| | 37.55 | |

A test composition (A) according to the invention was then prepared by adding 0.3 parts by weight of α-amylase (TERMAMYL 60-L) to mixture (C).

A set of test soiled kitchen or table wares was prepared by using common food residues of the following kinds: amylaceous material, proteins, vegetable fibers, dyestuffs and tannins (tea), burnt food and mixed soils (protein/starch). This was made by coating the dinner wares (plate, cup, glass, beaker, forks and spoons, etc., depending on the needs) with a known quantity of food residue and, thereafter, drying for a known period at a given temperature. The conditions under which the test articles were prepared are summarized in Table I below.

TABLE I

| Type of food stuff residue | Weight of food residue per utensil (g) | Drying conditions time (h) | Drying conditions temperature (°C.) |
|---|---|---|---|
| (a) cellulosic fibers | spinach (2) | 2 | 95 |
| (b) protein | egg yolk (2) | 2 | 115 |
| (c) amylaceous products | porridge (3) | 2 | 80 |
| (d) proteins/amylaceous products | cheese noodles (2) | 16 | 115 |
| (e) dyes and tannins | tea (50) | filled cup 1 | 100 |
| | | empty cup 2 | 100 |
| (f) burnt stuff | milk (1) | 2 | 80 |

The soiled utensils were introduced into commercial dish-washers so as to provide normal filling loads, i.e. for instance 6 ordinary plates, 6 soup bowls, 6 dessert plates, 6 stainless knives, spoons and forks, 6 tea cups, 6 beakers with burnt milk residues and, also, clean glasses to check rinsing efficiency. The washing operation was carried out under "normal" washing cycle conditions with a prewashing step. The washing steps are summarized in Table II below (the given parameters stand for 29.95 g of powdered detergent composition; the initial water temperature was 15° C.).

TABLE II

| Consecutive steps | Duration (min) | water used (liter) | final temperature (°C.) |
|---|---|---|---|
| Prewash | 2 | 7.2-7.6 | 15 |
| Main wash with detergent | 26 | 7.2-7.6 | 60 |
| 1st rinse | 3 | 10.2-10.8 | 35 |
| 2nd rinse | 2.5 | 7.2-7.6 | 25 |
| 3rd rinse (with 3 ml of acid surfactant solution) | 27 | 7.2-7.6 | 60 |

The composition labelled (A) as described above was used in the above mentioned washing test (using about 3 g of detergent/liter) at a pH of 11.5 in a first test and at pH 12.2 in a second identical test. The pH was adjusted in both cases into concentrated HCl or NaOH solutions as required. The washing and rinsing results are gathered in Table III, the evaluation marks ("good", "sufficient" and "insufficient") being averaged over several repeats as objectively as possible. The marks "insufficient" and "much insufficient" indicate that significant soil residues remain on the dishes; "sufficient" indicates that the test ware is acceptably clean while "good" indicates that the ware is absolutely clean.

TABLE III

| Type of soil | pH = 11.5 | pH = 12.2 |
|---|---|---|
| (a) | sufficient | good |
| (b) | insufficient | good |
| (c) | sufficient | sufficient |
| (d) | sufficient | good |
| (e) | much insufficient | good |
| (f) | sufficient | sufficient |
| rinse (glass) | good | good |

A comparison was thereafter made between composition (A) and control composition (C) without TERMAMYL at pH 12.2 and under the same conditions as above; it was noted that composition (A) provided much better washing results than the control, especially with regard to the removal of amylaceous materials (C) and mixed soils amylaceous/proteins (d).

Then, the amylolytic activity of the solutions obtained from composition (A) at pH values of, respectively, 12.2 and 8.0 was checked as follows: in a conventional type dish-washer were introduced 4 liters of 25 g/l starch solution; the machine was started but, before adding the detergent composition, an aliquot of the liquid was taken for analysis. Then, the full washing cycle was carried out with the detergent solution and a second identical sample of liquid was removed. The amylolytic activity was determined by adding an excess of iodine to the sample (iodine is normally consumed in alcaline medium in a ratio of 2 atoms of I per aldehyde function) and back titrating the excess of iodine with thiosulfate. The consumption difference between the initial sample and the final sample taken at the end of the washing cycle provides a measurement of the extent of hydrolytic cleavage of the amylaceous chains (formation of —CHO groups) undergone by the starch in the course of the washing cycle. The activity measured for 200 ml samples (from a total volume of 4+3.5=7.5 liters of washing bath) with 30 ml of O.N $I_2$ solutions provided for three successive test at pH 12.2 the following iodine consumption values (in ml of 0.1N $I_2$ solution): 0.82; 1.14; and 0.16, these results corresponding approximately to zero activity within the limits of error of the measurements. In comparison, at pH 8, values averaging to 8–9 ml (over 5 runs) were recorded which indicates the existence of quite a significant activity. It is hence particularly surprising that the present composition is so effective at pH 12.2 to eliminate amylaceous residues when its hydrolyzing activity is indeed naught or non-detectable by the abovementioned conventional means.

As a confirmation of the aforementioned results, one may referentially check up with the FIGURE of the annexed drawing. The graph of this FIGURE represents in KNU'g units the activity of the enzyme TERMAMYL as the function of pH at three different temperatures. The curves represented show that the activity is practically zero at pH values over 11. It is thus particularly surprinsing to note that the composition according to the invention is active with regard to amylaceous residues at a pH above 11.5.

EXAMPLE 2

A detergent composition (B) was prepared which was identical with composition (A) of Example 1 except for the sodium perborate which was omitted. The composition (A) and (B) were comparatively tested at pH 12.2 exactly as disclosed in Example 1 and the results listed in Table IV were obtained.

TABLE IV

| Type of soil | Composition (B) | Composition (A) |
|---|---|---|
| (a) | good | good |
| (b) | good | sufficient |
| (c) | good | good |
| (d) | good | good |
| (e) | insufficient | good |
| (f) | good | good |
| rinse (glasses) | good | good |

The above results indicate that although the protein removal potency of the composition is somewhat weakened by the presence of perborates, the efficacy for removing tea spots which was insufficient in the absence of perborate becomes good when the latter is present.

EXAMPLE 3

A comparison was made between the composition (A) of Example 1 operating at pH 12.2 and a commercial dish-washing powder (D) without enzymes but containing about 3% of chlorine bleach. This control powder had the following composition (for 30.0 g of washing product):

| | |
|---|---|
| Tripolyphosphate | 12.75 g |
| Anhydrous sodium metasilicate | 12.00 g |
| PLURAFAC RA 343 (a non-ionic surfactant) | 0.75 g |
| Sodium carbonate | 3.60 g |

-continued

| | |
|---|---|
| Sodium dichloroisocyanurate.$4H_2O$ | 0.90 g |

This detergent composition was to operate at pH 12.0.

The tests were carried out with, each time, 30 g of control composition (D) or test composition (A) but with different washing programs: "normal" "economical" and "delicate". The results are provided in Table V. The detailed steps of the "economical" and "delicate" programs are given in Tables VI and VII hereinafter. The initial water temperature was 15° C.

TABLE V

| Type of soil | Program: Normal A | Normal D | Economy A | Economy D | Soft A | Soft D |
|---|---|---|---|---|---|---|
| (a) | good | suff. | good | good | suff. | suff. |
| (b) | good | m.ins. | suff. | insuf. | suff. | m.ins. |
| (c) | good | m.ins. | good | m.ins. | suff. | m.ins. |
| (d) | good | m.ins. | good | insuf. | suff. | m.ins. |
| (e) | good | good | good | good | good | good |
| (f) | good | good | good | suff. | suff. | insuf. |
| rinse (glasses) | good | good | good | good | good | good |

Suff = sufficient;
insuf = insufficient;
m.ins. = much insufficient.

The above results indicate that in some occasions, the "economy" program performed with the composition of the invention provides better results than that obtained with the commercial reference solution under a "normal" washing cycle.

TABLE VI (economy program)

| Steps | Duration (min) | Water (l) | Final temperature (°C.) |
|---|---|---|---|
| washing with detergent | 26 | 7.2–7.4 | 50 |
| 1st rinse | 3 | 10.2–10.8 | 30 |
| 2nd rinse | 2.5 | 7.2–7.6 | 20 |
| 3rd rinse with rinsing agent | 27 | 7.2–7.6 | 60 |

TABLE VII (Delicate program)

| Steps | Duration (min) | Water (l) | Final temperature (°C.) |
|---|---|---|---|
| washing with detergent | 16 | 7.2–7.6 | 50 |
| 1st rinse | 3 | 10.2–10.8 | 30 |
| 2nd rinse | 2.5 | 7.2–7.6 | 20 |
| 3rd rinse with rinsing agent | 27 | 7.2–7.6 | 60 |

We claim:

1. Detergent dish-washing composition containing alkali metals polyphosphates and silicates, at least one non-ionic surfactant, at least one oxidizing agent, enzymes and optionally other conventional additives suitable for detergents, characterized in that said enzymes comprise at least one amylolytic enzyme whose activity is considered to be negligible at pH above 11.5, in that the oxidant is at least one mineral or organic peroxide and in that the alkali content is sufficient to provide a washing bath in a dish-washing machine with a pH above 12.2.

2. The composition of claim 1 wherein the peroxide is sodium perborate and further comprising the following ingredients by weight:

| | |
|---|---|
| alkali metals polyphosphates | 10–70% |
| alkali metals silicates | 25–70% |
| non-ionic surfactants | 0.2–5% |
| amylolytic enzymes | 0.1–5% |
| sodium perborate | 0.1–20% |

-continued

| | |
|---|---|
| further additives | balance to 100% |

3. The composition of claim 1 wherein said alkali content is sufficient to provide said washing bath with a pH of about 12.2 to 12.4.

4. The composition of claim 2 wherein said alkali content is sufficient to provide said washing bath with a pH of about 12.2 to 12.4.

* * * * *